US006751592B1

(12) United States Patent
Shiga

(10) Patent No.: US 6,751,592 B1
(45) Date of Patent: Jun. 15, 2004

(54) SPEECH SYNTHESIZING APPARATUS, AND RECORDING MEDIUM THAT STORES TEXT-TO-SPEECH CONVERSION PROGRAM AND CAN BE READ MECHANICALLY

(75) Inventor: Yoshinori Shiga, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/480,654

(22) Filed: Jan. 11, 2000

(30) Foreign Application Priority Data

Jan. 12, 1999 (JP) ..... 11-005443

(51) Int. Cl.[7] ..... G10L 13/00
(52) U.S. Cl. ..... 704/258; 704/260
(58) Field of Search ..... 704/258, 260

(56) References Cited

U.S. PATENT DOCUMENTS

| | | | | | |
|---|---|---|---|---|---|
| 4,214,125 | A | * | 7/1980 | Mozer et al. | 704/207 |
| 4,692,941 | A | * | 9/1987 | Jacks et al. | 704/260 |
| 5,010,495 | A | * | 4/1991 | Willetts | 434/167 |
| 5,636,325 | A | * | 6/1997 | Farrett | 704/231 |
| 5,729,694 | A | * | 3/1998 | Holzrichter et al. | 704/270 |
| 5,788,503 | A | * | 8/1998 | Shapiro et al. | 434/167 |

FOREIGN PATENT DOCUMENTS

| | | |
|---|---|---|
| JP | 2-293900 | 12/1990 |
| JP | 3-63696 | 3/1991 |

OTHER PUBLICATIONS

Port et al, "Intelligibility and Acoustic Correlates of Japaneses Accented English Vowels", ICSLP '96, pp. 378–381.*
Strom et al, What's in the 'Prosody', ICSLP '96, pp. 1497–1500.*
Fujisaki et al, "Realization of Linguistic Information in the Voice Fundamental Frequency Contour of the Spoken Japanese", ICASSP–88, pp. 663–666, vol. 1.*
Hara Y. et al., "Development of TTS Card for PCS and TTS Software for WSs", IEICE Transactions of Fundamentals of Electronics, Communications and Computer Sciences, vol. E76–A, No. 11, Nov. 1993, pp. 1999–2007.

* cited by examiner

*Primary Examiner*—Richemond Dorvil
*Assistant Examiner*—Michael N. Opsasnick
(74) *Attorney, Agent, or Firm*—Finnegan, Henderson, Farabow, Garrett & Dunner, L.L.P.

(57) ABSTRACT

A text analysis section reads, from a text file, a text to be subjected to speech synthesis, and analyzes the text using a morphological analysis section, a syntactic structure analysis section, a semantic analysis section and a similarly-pronounced-word detecting section. A speech segment selecting section incorporated in a speech synthesizing section obtains the degree of intelligibility of synthetic speech for each accent phrase on the basis of the text analysis result of the text analysis section, thereby selecting a speech segment string corresponding to each accent phrase on the basis of the degree of intelligibility from one of a 0th-rank speech segment dictionary, a first-rank speech segment dictionary and a second-rank speech segment dictionary. A speech segment connecting section connects selected speech segment strings and subjects the connection result to speech synthesis performed by a synthesizing filter section.

9 Claims, 6 Drawing Sheets

FIG. 4A

INPUT TEXT : 年号を誤って評成と記入してしまったので,正しい年号の平成に訂正した。

FIG. 4B

| TEXT (ACCENT PHRASE UNIT) | 年号を (nengo:wo) | 誤って (aya matte) | 評成と (hyoseito) | 記入して (kinyu: shite) | しまったので (shimattanode) | 正しい (tadashii) | 年号の (nengo:no) | 平成に (heiseini) | 訂正した (teiseishita) |
|---|---|---|---|---|---|---|---|---|---|
| PART OF SPEECH IN INDEPENDENT SECTION | NOUN | VERB | NOUN | VERB | - | ADJECTIVE | NOUN | NOUN | VERB |
| UNKNOWN-WORD FLAG | 0 | 0 | 1 | 0 | 0 | 0 | 0 | 0 | 0 |
| INTRA-TEXT POSITION | 1 | 2 | 3 | 4 | 5 | 6 | 7 | 8 | 9 |
| FREQUENCY OF SAME NOUN | 2 | - | - | 9 | - | - | 2 | 3 | 8 |
| ORDER OF APPEARANCE OF SAME NOUN | 1 | - | 1 | 1 | - | - | 2 | 1 | 1 |
| WHETHER OR NOT THERE IS EMPHASIS | 0 | 0 | 1 | 0 | 0 | 0 | 0 | 1 | 0 |

FIG. 4C

| TEXT (ACCENT PHRASE UNIT) | 年号を (nengo:wo) | 誤って (aya matte) | 評成と (hyoseito) | 記入して (kinyu: shite) | しまったので (shimattanode) | 正しい (tadashii) | 年号の (nengo:no) | 平成に (heiseini) | 訂正した (teiseishita) |
|---|---|---|---|---|---|---|---|---|---|
| PART OF SPEECH IN INDEPENDENT SECTION | NOUN | VERB | NOUN | VERB | - | ADJECTIVE | NOUN | NOUN | VERB |
| UNKNOWN-WORD FLAG | 0 | 0 | 1 | 0 | 0 | 0 | 0 | 0 | 0 |
| INTRA-TEXT POSITION | 1 | 2 | 3 | 4 | 5 | 6 | 7 | 8 | 9 |
| FREQUENCY OF SAME NOUN | 2 | - | - | 9 | - | - | 2 | 3 | 8 |
| ORDER OF APPEARANCE OF SAME NOUN | 1 | - | 1 | 1 | - | - | 2 | 1 | 1 |
| WHETHER OR NOT THERE IS EMPHASIS | 0 | 0 | 1 | 0 | 0 | 0 | 0 | 1 | 0 |
| EXISTENCE OF SIMILARLY PRONONCED WORD | 0 | 0 | 0 | 0 | 0 | 0 | 0 | 1 | 1 |

FIG. 7

| TEXT (ACCENT PHRASE UNIT) | 年号を (nengo:wo) | 誤って (aya matte) | 評成と (hyoseito) | 記入して (kinyu: shite) | しまったので (shimattanode) | 正しい (tadashii) | 年号の (nengo:no) | 平成に (heiseini) | 訂正した (teiseishita) |
|---|---|---|---|---|---|---|---|---|---|
| PART OF SPEECH IN INDEPENDENT SECTION | 1 | 0 | 1 | 0 | 0 | 1 | 1 | 1 | 0 |
| UNKNOWN-WORD FLAG | 0 | 0 | 1 | 0 | 0 | 0 | 0 | 0 | 0 |
| INTRA-TEXT POSITION | 1 | 0 | 0 | 0 | 0 | 0 | 0 | 0 | 0 |
| FREQUENCY OF SAME NOUN | 1 | 0 | 0 | 0 | 0 | 0 | 1 | 0 | 0 |
| ORDER OF APPEARANCE OF SAME NOUN | 0 | 0 | 0 | 0 | 0 | 0 | -1 | 0 | 0 |
| WHETHER OR NOT THERE IS EMPHASIS | 0 | 0 | 1 | 0 | 0 | 0 | 0 | 1 | 0 |
| EXISTENCE OF SIMILARLY PRONONCED WORD | 0 | 0 | 0 | 0 | 0 | 0 | 0 | 1 | 1 |
| TOTAL SCORE | 3 | 0 | 3 | 0 | 0 | 1 | 1 | 3 | 1 |

FIG. 8A

"年号を誤って評成と記入してしまったので,正しい年号の平成に訂正した。"

"SINCE THE NAME OF THE ERA WAS ERRONEOUSLY WRITTEN 'HYOSEI', IT HAS BEEN REVISED TO A CORRECT ERA 'HEISEI'."

FIG. 8B

DOUBLE UNDERLINE SECTION (SCORE : 2 OR MORE)
→ PERFORM SYNTHESIZATION USING SPEECH SEGMENTS PRODUCED WITH HIGH INTELLIGIBILLITY

SINGLE UNDERLINE SECTION (SCORE : 1)
→ PERFORM SYNTHESIZATION USING SPEECH SEGMENTS PRODUCED WITH MEDIUM INTELLIGIBILLITY

NO UNDERLINE SECTION (SCORE : 0)
→ PERFORM SYNTHESIZATION USING SPEECH SEGMENTS PRODUCED NATURAL (LOW) INTELLIGIBILLITY

SPEECH SYNTHESIZING APPARATUS, AND RECORDING MEDIUM THAT STORES TEXT-TO-SPEECH CONVERSION PROGRAM AND CAN BE READ MECHANICALLY

BACKGROUND OF THE INVENTION

This invention relates to a speech synthesizing apparatus for selecting and connecting speech segments to synthesize speech, on the basis of phonetic information to be subjected to speech synthesis, and also to a recording medium that stores a text-to-speech conversion program and can be read mechanically.

Attempts to make a computer recognize patterns or understand/express a natural language are now being executed. For example, a speech synthesizing apparatus is one means for producing speech by a computer, and can realize communication between computers and human beings.

Speech synthesizing apparatuses of this type have various speech output methods such as a waveform encoding method, a parameter expression method, etc. A rule-based synthesizing apparatus is a typical example which subdivides a sound into sound components, accumulates them and combines them into an optional sound.

Referring now to FIG. 1, a conventional example of the rule-based synthesizing apparatus will be described.

FIG. 1 is a block diagram illustrating the conventional rule-based synthesizing apparatus. This apparatus performs text-to-speech conversion (hereinafter referred to as "TTS"), in which input text data (hereinafter referred simply to as a "text") is converted into a phonetic symbol string that consists of phoneme information (information concerning pronunciation) and prosodic information (information concerning the syntactic structure, lexical accent, etc. of a sentence), thereby creating speech from the phonetic symbol string. A TTS processing mechanism employed in the rule-based synthesizing apparatus of FIG. 1 comprises a linguistic processing section 32 for analyzing the language of a text 31, and speech synthesizing section 33 for performing speech synthesizing processing on the basis of the output of the linguistic processing section 32.

For example, rule-based synthesis of Japanese is generally executed as follows:

First, in the linguistic processing section 32, morphological analysis in which a text (including Chinese characters and Japanese syllabaries) input from a text file 31 is dissected into morphemes, and then linguistic processing such as syntactic structure analysis is performed. After that, the linguistic processing section 32 determines the "type of accent" of each morpheme based on "phoneme information" and the position of the accent. Subsequently, the linguistic processing section 32 determines the "accent type" of each phrase that serves as a pause during vocalization (hereinafter refereed to as a "accent phrase").

The text data processed by the linguistic processing section 32 is supplied to the speech synthesizing section 33.

In the speech synthesizing section 33, first, a phoneme duration determining/processing section 34 determines the duration of each phoneme included in the above "phoneme information".

Subsequently, a phonetic parameter generating section 36 reads necessary speech segments from a speech segment storage 35 that stores a great number of pre-created speech segments, on the basis of the above "phoneme information". The section 36 then connects the read speech segments while expanding and contracting them along the time axis, thereby generating a characteristic parameter series for to-be-synthesized speech.

Further, in the speech synthesizing section 33, a pitch pattern creating section 37 sets a point pitch on the basis of each accent type, thereby performing linear interpolation between each pair of adjacent ones of a plurality of set point pitches, to thereby create the accent components of pitch. Moreover, the pitch pattern creating section 37 creates a pitch pattern by superposing the accent component with a intonation component which represents a gradual lowering of pitch.

Finally, a synthesizing filter section 38 synthesizes desired speech by filtering.

In general, when a person speaks, he or she intentionally or unintentionally vocalizes a particular portion of the speech as to make it easier to hear than other portions. The particular portion indicates, for example, where a word which serves an important role to indicate the meaning of the speech is vocalized, where a certain word is vocalized for the first time in the speech, or where a word which is not familiar to the speaker or to the listener is vocalized. It also indicates that where a word is vocalized, if another word that has a similar pronunciation to the first-mentioned one exists in the speech, the listener may mistake the meaning of the word. On the other hand, at a portion of the speech other than the above, a person sometimes vocalizes a word in a manner which is not so easy to be heard, or which is rather ambiguous. This is because the listener will easily understand the word even if it is vocalized rather ambiguously.

However, the conventional speech synthesizing apparatus represented by the above-described rule-based synthesizing apparatus has only one type of speech segment with respect to one, and hence speech synthesis is always executed using speech segments that have the same degree of "intelligibility". Accordingly, the conventional speech synthesizing apparatus cannot adjust the degree of the "intelligibility" of synthesized sounds. Therefore, if only speech segments that have an average degree of hearing easiness are used, it is difficult for the listener to hear them where the word should be vocalized in a manner easy to hear as aforementioned. On the other hand, if only speech segments that have a high degree of hearing easiness are used, all portions of all sentences are vocalized with clear pronunciation, which means that the listener does not hear smoothly synthesized sounds.

In addition, there exists another type of conventional speech synthesizing apparatus, in which a plurality of speech segments are prepared for one type of synthesis unit. However, it also has the above-described drawback since different speech segments are used for each type of synthesis unit in accordance with the phonetic or prosodic context, but irrespective of the adjustment of "intelligibility".

BRIEF SUMMARY OF THE INVENTION

The present invention has been developed in light of the above, and is aimed at providing a speech synthesizing apparatus, in which a plurality of speech segments of different degrees of intelligibility for each type of unit are prepared, and are changed from one to another in the TTS processing in accordance with the state of vocalization, so that speech is synthesized in a manner in which the listener can easily hear it and does not tire even after hearing it for a long time. The invention is also aimed at providing a mechanically readable recording medium that stores a text-to-speech conversion program.

According to an aspect of the invention, there is provided a speech synthesizing apparatus comprising: text analyzing means for dissecting and analyzing text data, subjected to speech synthesis, into to-be-synthesized units and analyzing each to-be-synthesized unit, thereby obtaining a text analysis result; a speech segment dictionary that stores speech segments prepared for each of a plurality of ranks of intelligibility; determining means for determining in which rank a present degree of intelligibility is included, on the basis of the text analysis result; and synthesized-speech generating means for selecting speech segments stored in the speech segment dictionary and each included in a rank corresponding to the determined rank, and then connecting the speech segments to generate synthetic speech.

According to another aspect of the invention, there is provided a mechanically readable recording medium storing a text-to-speech conversion program for causing a computer to execute the steps of: dissecting text data, to be subjected to speech synthesis, into to-be-synthesized units, and analyzing the units to obtain a text analysis result; determining, on the basis of the text analysis result, a degree of intelligibility of each the to-be-synthesized unit; and selecting, on the basis of the determination result, each speech segments of a degree corresponding to each of the to-be-synthesized units, from a speech segment dictionary, in which speech segments of the plurality of degree of intelligibility is stored, and connecting the speech segments to obtain synthetic speech.

According to a further aspect of the invention, there is provided a mechanically readable recording medium storing a text-to-speech conversion program for causing a computer to execute the steps of: dissecting text data, to be subjected to speech synthesis, into to-be-synthesized units, and analyzing the to-be-synthesized units to obtain a text analysis result for each to-be-synthesized unit, the text analysis result including at least one of information items concerning grammar, meaning, familiarity and pronunciation; determining a degree of intelligibility of each the to-be-synthesized unit, on the basis of the at least one of the information items concerning the grammar, meaning, familiarity and pronunciation; and selecting, on the basis of the determination result, each speech segments of a degree corresponding to each of the to-be-synthesized units, from a speech segment dictionary that stores speech segments of the plurality of degrees of intelligibility of each the to-be-synthesized unit, and connecting the speech segments to obtain synthetic speech.

In the above structure, the degree of intelligibility of a to-be-synthesized text is determined for each to-be-synthesized unit on the basis of a text analysis result obtained by text analysis, and speech segments of a degree corresponding to the determination result, which can be synthesized, are selected and connected, thereby creating corresponding speech. Accordingly, the contents of synthesized speech can be made easily understandable by using speech segments of a degree corresponding to a high intelligibility, for the portion of a text indicated by the text data, which is considered important for the users to estimate the meaning of the text, and using speech segments of a degree corresponding to a low intelligibility for other portions of the text.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 4A is a view showing a to-be-analyzed text by rule-based synthesizing apparatus according to the embodiment of the invention;

FIG. 4B is a view showing examples of text analysis results obtained using a text analysis section 10, which includes a morphological analysis section 104, a syntactic structure analysis section 106 and a semantic analysis section 107;

FIG. 4C shows examples of information items output from the similarly-pronounced-word detecting section 108 when the text analysis results shown in FIG. 4B have been supplied thereto;

FIG. 7 is a view showing examples of score calculation results based on text analysis results as shown in FIG. 3 and obtained in the speech segment selecting section 204; and FIGS. 8A and 8B are views showing examples of selection results of speech segments (the speech segment dictionary) based on the score calculation results shown in FIG. 6 and obtained in the speech segment selecting section 204.

DETAILED DESCRIPTION OF THE INVENTION

With reference to the accompanying drawings, a description will be given of a speech synthesizing apparatus according to the embodiment of the present invention, in which the apparatus is applied to a rule-based Japanese speech synthesizing apparatus.

Figure 1:
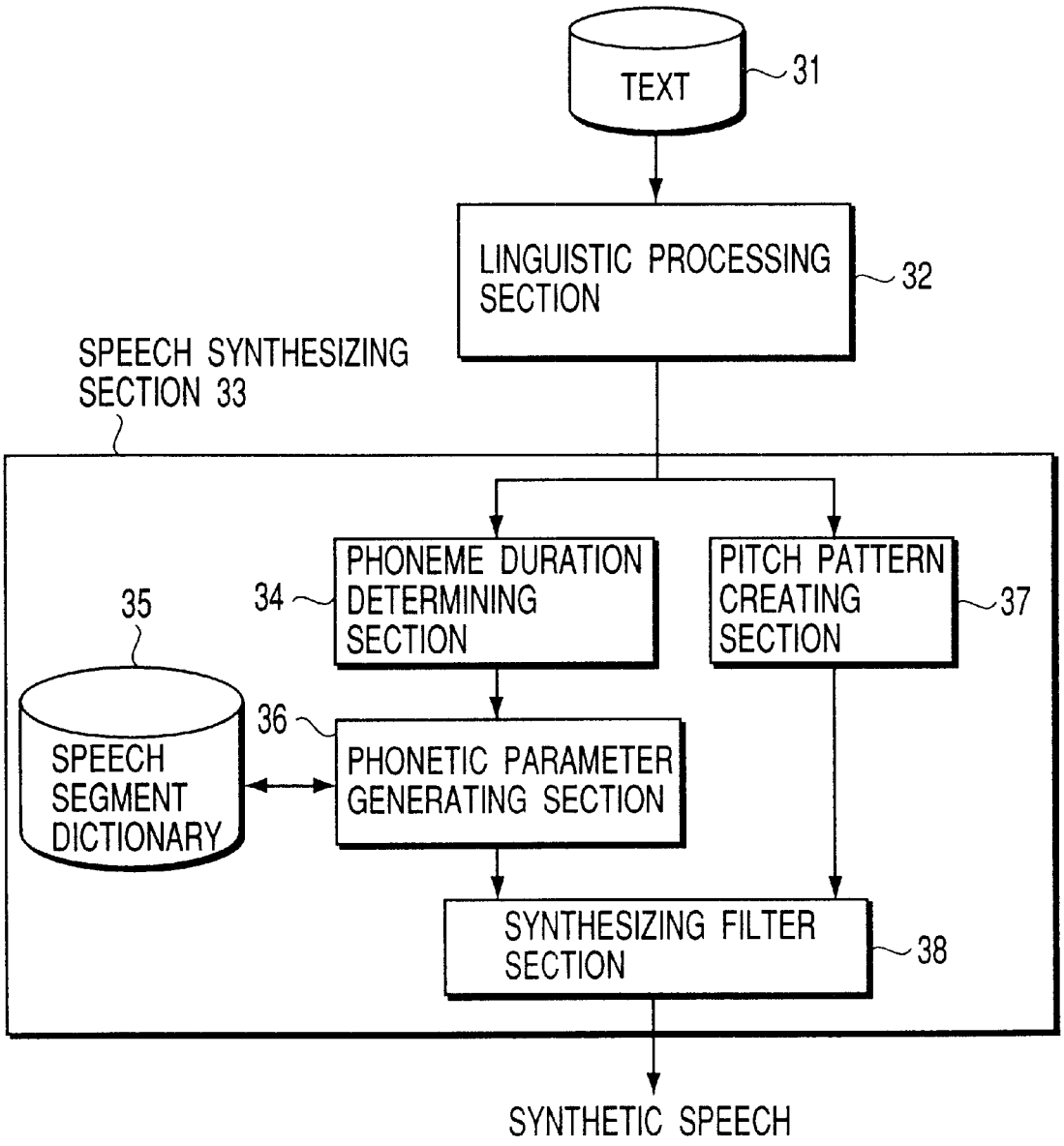
FIG. 1 PRIOR ART
FIG. 1 is a block diagram illustrating a conventional rule-based synthesizing apparatus.
Figure 2:
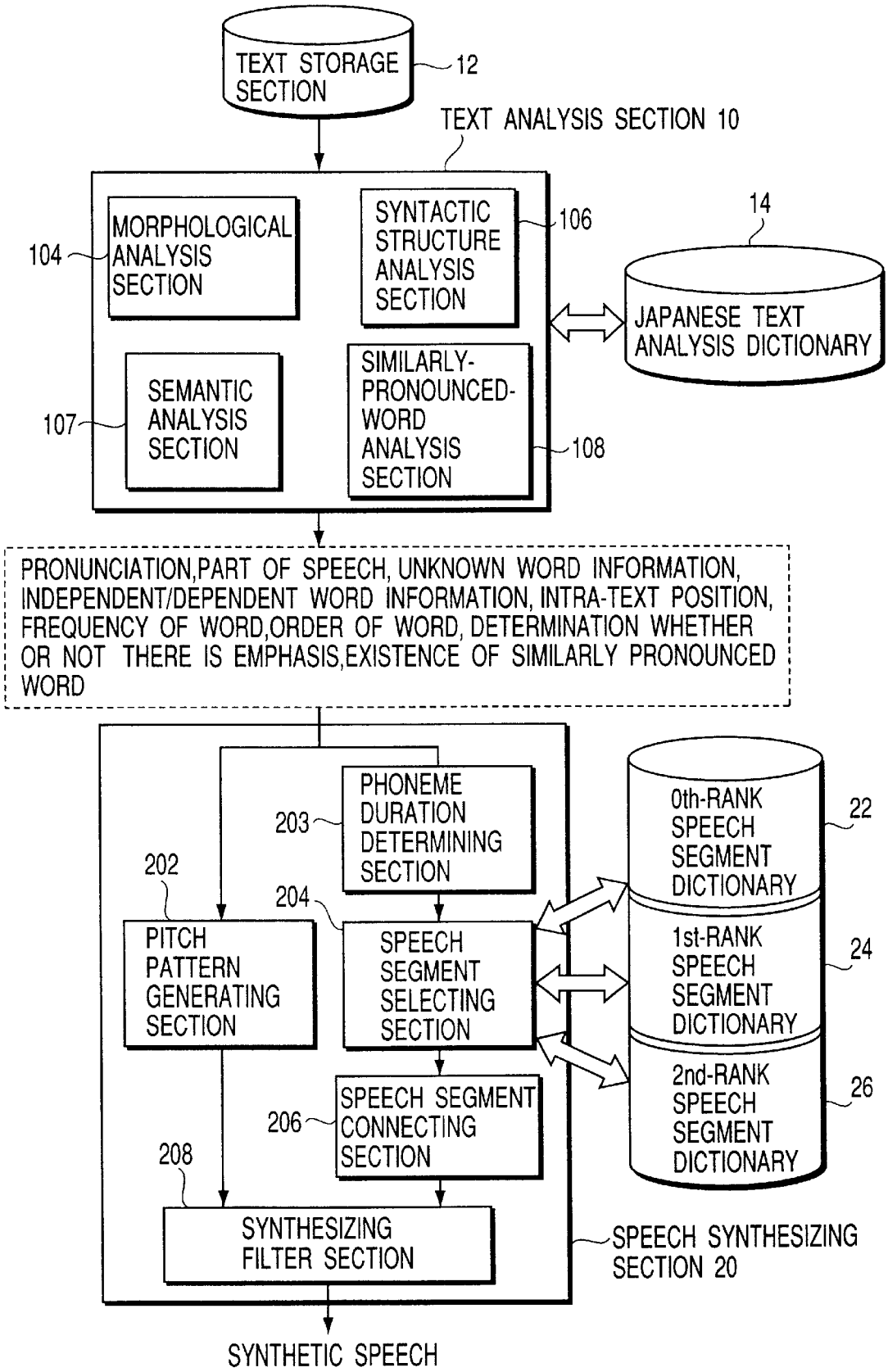
FIG. 2 is a schematic block diagram illustrating a rule-based synthesizing apparatus according to the embodiment of the invention.

FIG. 2 is a schematic block diagram illustrating a speech rule-based synthesizing apparatus according to the embodiment of the invention.

The speech rule-based synthesizing apparatus of FIG. 2 (hereinafter referred to as a "speech synthesizing apparatus") is realized by executing, in an information processing apparatus such as a personal computer, exclusive text-to-speech conversion software (a text-to-speech conversion program) supplied from a recording medium such as a CD-ROM, a floppy disk, a hard disk, a memory card, etc., or from a communication medium such as a network. This speech synthesizing apparatus performs text-to-speech conversion (TTS), in which input text data (hereinafter referred simply to as a "text") is converted into a phonetic symbol string that consists of phoneme information (information concerning pronunciation) and prosodic information (information concerning the syntactic structure, lexical accent, etc. of a sentence), thereby creating speech from the phonetic symbol string. This speech synthesizing apparatus mainly comprises a text storage section 12 that stores, as texts, Japanese documents consisting of Chinese characters and Japanese syllabaries and to be subjected to speech synthesis, a text analysis section 10 for inputting each text and analyzing it linguistically, a Japanese text analysis dictionary 14 used for text analysis, a speech synthesizing section 20 for synthesizing speech on the basis of the output of the linguistic analysis, and speech segment dictionaries 22, 24 and 26 used for speech synthesis.

In the speech synthesizing apparatus of FIG. 2, the text storage section 12 stores, as a text file, a text (in this case, a Japanese document) to be subjected to text-to-speech conversion.

The text analysis section 10 reads a text from the text storage section 12 and analyzes it. In the analysis performed by the text analysis section 10, the morphemes of the text are analyzed to determine words (morphological analysis processing); the structure of a sentence is estimated on the basis of obtained information on parts of speech, etc. (structure analysis processing); it is estimated which word in a sentence to be synthesized has an important meaning (prominence), i.e. which word should be emphasized (semantic analysis processing); words that have similar pronunciations and hence are liable to erroneously be caught are detected (similar pronunciation detection processing); and the processing results are output.

In the embodiment, to-be-synthesized unit in a speech synthesizing is treated as accent phrase unit of a text. In the embodiment, "intelligibility" of the to-be-synthesized unit is defined as articulation of the to-be-synthesized unit when the to-be-synthesized unit is synthesized. In other words, "intelligibility" of the to-be-synthesized unit is defined as clear speaking of the to-be-synthesized unit. Moreover, in the embodiment, four standards, i.e. "grammar", "meaning", "familiarity" and "pronunciation", are prepared as examples to analyze the "intelligibility" of each accent phrase unit of a text when the accent phrases are synthesized. The degree of "intelligibility of the each accent phrase when the accent phrases are synthesized" is now evaluated by using these four standards. The degree of intelligibility evaluation of each accent phrase unit, which will be described in detail later, is executed concerning nine items, i.e. determination as to whether or not the unit is an independent word (grammatical standard; where an independent word is a word whose part of speech is a noun, a pronoun, a verb, an adjective, an adjective verb, an adverb, a conjunction, an interjection or a demonstrative adjective in Japanese grammar. Moreover, dependent word is a word whose part of speech is a particle or a auxiliary verb in Japanese grammar.), determination of the type of the independent word (grammatical standard), determination as to whether or not there is an emphasis in a text (meaning standard), determination of the position of the unit in the text (meaning standard), determination of the frequency and order of the unit in the text (familiarity), information on an unknown word (familiarity), and determination as to whether there are units of the same or similar pronunciations (pronunciation). In particular, seven items, except for the evaluation as to whether or not each unit is independent, and the pronunciation of each unit, are subjected to scoring as described later. The total score is used as a standard for the evaluation of the degree of intelligibility of each accentual unit.

The Japanese text analysis dictionary 14 is a text analyzing dictionary used, in morphological analysis described later, for identifying an input text document. For example, the Japanese text analysis dictionary 14 stores information used for morphological analysis, the pronunciation and accent type of each morpheme, and the "frequency of appearance" of the morpheme in the speech if the morpheme belongs to a noun (including a noun section that consists of a noun and an auxiliary verb to form a verb). Accordingly, the morpheme is determined by morphological analysis, so that the pronunciation, accent type, and frequency of appearance of the morpheme can be simultaneously imparted by reference to the Japanese text analysis dictionary 14.

The speech synthesizing section 20 performs speech synthesis on the basis of a text analysis result as an output of the text analysis section 10. The speech synthesizing section 20 evalutates the degree of intelligibility on the basis of the analysis result of the text analysis section 10. The degree of intelligibility of each accent phrase is evaluated in three ranks based on the total score concerning the aforementioned seven items of the text analysis. On the basis of this evaluation, speech segments are selected from corresponding speech segment dictionaries (speech segment selection processing), and connected in accordance with the text (speech segment connection processing). Further, setting and interpolation of pitch patterns for the phoneme information of the text is performed (pitch pattern generation processing), thereby performing speech output (synthesized filtering processing) using a LMA filter in which the cepstrum coefficient is directly used as the filter factor.

The 0th-rank speech segment dictionary 22, the first-rank speech segment dictionary 24 and the second-rank speech segment dictionary 26 are speech segment dictionaries that correspond to the three ranks prepared on the basis of the intelligibility of speech segments obtained when the speech are synthesized using the speech sugments. The three ranks correspond that the degree of intelligibility is evaluated according to three ranks in a speech segment selecting section 204. In the rule-based speech synthesizing apparatus according to this embodiment, speech segment files of three ranks (not shown) corresponding to three different degrees of intelligibility of speech segments are prepared. Here, "intelligibility" of a speech segment is defined as articulation of speech synthesized with the speech segment. In other words, "intelligibility" of a speech segment is defined as clear speaking of speech synthesized with the speech segment. A speech segment file of each rank stores 137 speech segments. These speech segments are prepared by dissecting, in units of one combination of a consonant and a vowel (CV), all syllables necessary for synthesis of Japanese speech on the basis of low-order (from 0th to 25th) cepstrum coefficients. These cepstrum coefficients are obtained by analyzing actual sounds sampled with a sampling frequency of 11025 Hz, by the improved cepstrum method that uses a window length of 20 msec and a frame period of 10 msec. Suppose that the contents of the three-rank speech segment file are read as speech segment dictionaries 22, 24 and 26 in speech segment areas of different ranks defined in, for example, a main storage (not shown), at the start of the text-to-speech conversion processing according to the text-to-speech software. The 0th-rank speech segment dictionary 22 stores speech segments produced with natural (low) intelligibility. The second-rank speech segment dictionary 26 stores speech segments produced with a high intelligibility. The first-rank speech segment dictionary 24 stores speech segments produced with a medium intelligibility that falls between the 0th-rank and second-rank speech segment dictionaries 22 and 26. Speech segments stored in the speech segment dictionaries are selected by an evaluation method described later and subjected to predetermined processing, thereby performing synthesis of speech that can be easily heard and can keep the listener comfortable even after they heard it for a long time.

The above-mentioned low-order cepstrum coefficients can be obtained as follows: First, speech data obtained from, for example, an announcer is subjected to a window function (in this case, the Hunning window) of a predetermined width and cycle, thereby subjecting a speech waveform in each window to Fourier transform to calculate the short-term spectrum of the speech. Then, the logarithm of the obtained short-term spectrum power is calculated to obtain a logarithm power spectrum, which is then subjected to Fourier inverse transform. Thus, cepstrum coefficients are obtained. It is well known that high-order cepstrum coefficients indicate fundamental frequency information of speech, while low-order cepstrum coefficients indicate spectral envelope of the speech.

Each of analysis processing sections that constitute the text analysis section 10 will be described.

The morphological analysis section 104 reads a text from the text storage section 12 and analyzes it, thereby creating phoneme information and accent information. The morphological analysis indicates analysis for detecting which letter string in a given text constitutes a word, and the grammatical attribute of the word. Further, the morphological analysis section 104 obtains all morphological candidates with reference to the Japanese text analysis dictionary 14, and outputs a grammatically connectable combination. Also, when a word which is not stored in the Japanese text analysis dictionary 14 has been detected in the morphological analysis, the morphological analysis section 104 adds information that indicates that the word is an unknown one, and estimates the part of speech from the context of the text. Concerning the accent type and the pronunciation, the morphological analysis section 104 imparts to the word a likely accent type and pronunciation with reference to a single Chinese character dictionary included in the Japanese text analysis dictionary 14.

The syntactic structure analysis section 106 performs syntactic structure analysis in which the modification relationship between words is estimated on the basis of the grammatical attribute of each word supplied from the morphological analysis section 104.

The semantic analysis section 107 estimates which word is emphasized in each sentence, or which word has an important role to give a meaning, from the sentence structure, the meaning of each word, and the relationship between sentences on the basis of information concerning the syntactic structure supplied from the syntactic structure analysis section 106, thereby outputting information that indicates whether or not there is an emphasis (prominence).

No description will be given of the more details of the analysis method used in each processing section. However, it should be noted that, for example, such methods can be employed as described on pages 95–202 (concerning morphological analysis), on pages 121–124 (concerning structure analysis) and on pages 154–163 (concerning semantic analysis) of "Japanese Language Information Processing" published by the Institute of Electronics, Information and Communications Engineering and supervised by Makoto NAGAO.

The text analysis section 10 also includes a similarly-pronounced-word detecting section 108. The results of text analysis, performed using the morphological analysis section 104, the syntactic structure analysis section 106 and the semantic analysis section 107 incorporated in the section 10, are supplied to the similarly-pronounced-word detecting section 108.

The similarly-pronounced-word detecting section 108 adds information concerning a noun (including a noun section that consists of a noun and an auxiliary verb to form a verb), in a pronounced-word list (not shown) which stores words having appeared in the text and is controlled by the section 108. The pronounced-word list is formed of the pronunciation of each noun included in a text to be synthesized, and a counter (a software counter) for counting the order of appearance of the same noun, which indicates that the present noun is the n-th one of the same nouns having appeared in the to-be-synthesized text (the order of appearance of same noun).

Further, the similarly-pronounced-word detecting section 108 examines whether or not the pronounced-word list contains a word having a similar pronunciation which is liable to be erroneously heard on the basis of the pronounciation in pronounced-word list. This embodiment is constructed such that a word having only one different consonant from another word is determined to be a word having a similar pronunciation.

Moreover, after detecting a similarly pronounced word on the basis of the pronounced-word list, the similarly-pronounced-word detecting section 108 imparts, to the text analysis result, each counter value in the pronounced-word list indicating that the present noun is the n-th one of the same nouns having appeared in the text (the order of appearance of same noun), and also a flag indicating the existence of a detected similarly pronounced word (a similarly pronounced noun), thereby sending the counter-value-attached data to the speech synthesizing section 20.

Each processing to be executed in the speech synthesizing section 20 will be described.

The pitch pattern generating section 202 sets a point pitch at a point in time at which a change in high/low pitch occurs, on the basis of accent information contained in the output information of the text analysis section 10 and determined by the morphological analysis section 104. After that, the pitch pattern generating section 202 performs linear interpolation of a plurality of set point pitches, and outputs to a synthesizing filter section 208 a pitch pattern indicated by a predetermined period (e.g. 10 msec).

A phoneme duration determining section 203 determines the duration of each phoneme included in the "phoneme information" obtained as a result of the text analysis by the text analysis section 10. It is general that the phoneme duration is determined on the basis of mora isochronism, which is character of the Japanese. In this embodiment, the phoneme duration determining section 203 determines the duration of each of consonants to be constant in accordance with the kind of each consonant. The phoneme duration determining section 203 determines the duration of vowel, for example, in accordance with the procedure that crossover interval from consonant to vowel (a standard period of each of mora) is constant.

A speech segment selecting section 204 evaluates the degree of intelligibility of synthesized speech on the basis of information items, contained in information supplied from the phoneme duration determining section 203, such as the phoneme information of each accent phrase, the type of each independent word included in each accent phrase, unknown-word information (unknown-word flag), the position of each accent phrase in a text, the frequency of each noun included in each accent phrase and the order of appearance of each noun in the to-be-synthesize text, a flag indicating the existence of words having similar pronunciations (similarly pronounced nouns) in the text, and the determination as to whether or not each accent phrase is emphasized. On the basis of the evaluated degree of intelligibility, the speech segment selecting section 204 selects a target speech segment from one of the 0th-rank speech segment dictionary 22, the first-rank speech segment dictionary 24 and the second-rank speech segment dictionary 26. The evaluation manner of degree of intelligibility and the selection manner of a speech segment will be described later in detail.

The speech segment connecting section (phonetic parameter generating section) 206 generates a phonetic parameter (feature parameter) for speech to be synthesized, by sequentially interpolation-connecting speech segments from the speech segment selecting section 204.

The synthesizing filter section 208 synthesizes desired speech, on the basis of a pitch pattern generated by the pitch pattern generating section 202 and a phonetic parameter generated by the speech segment connecting section 206, by performing filtering using white noise in a voiceless zone and using impulses in a voice zone, as excitation source signal, and also using a filter coefficient calculated by the aforementioned feature parameter string. In this embodiment, an LMA (Log Magnitude Approximation) filter, which uses a cepstrum coefficient, a phonetic parameter, as a filter coefficient, is used as the synthetic filter of the synthesizing filter section 208.

Figure 3:
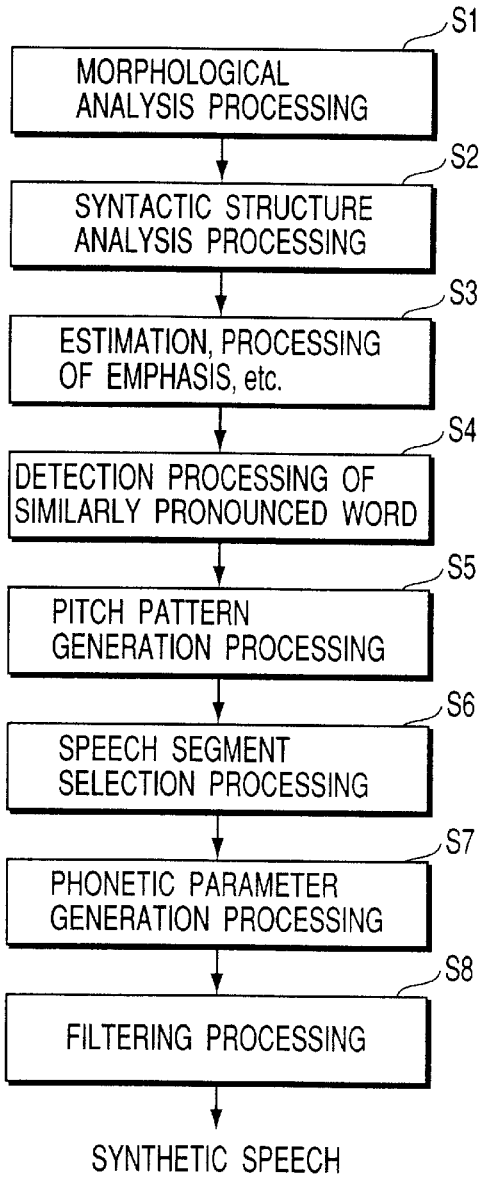
FIG. 3 is a flowchart useful in explaining speech synthesizing processing executed in the rule-based synthesizing apparatus of the embodiment.

Referring then to FIG. 3, a description will be given of the operation of the Japanese speech rule-based synthesizing apparatus, constructed as above, performed to analyze a text shown in FIG. 4A (In English, since the name of the era was erroneously written 'Hyosei', it has been revised to a correct era 'Heisei') and to generate synthetic speech.

First, the morphological analysis section 104 acquires information concerning a text read from the text storage section 12, such as information on the pronunciation or accent type of each word, information on the part of speech, unknown words (unknown-word flag), etc., the position of each word in the text (intra-text position), the frequency of each word (the frequency of the same noun) (step S1).

Subsequently, the syntactic structure analysis section 106 analyzes the structure of the text on the basis of grammatical attributes determined by the morphological analysis section 104 (step S2).

Then, the semantic analysis section 107 receives information concerning the text structure, and estimates the meaning of each word, an emphasized word, and an important word for imparting a meaning to the text. The semantic analysis section 107 acquires information as to whether or not each word is emphasized (step S3).

FIG. 4B shows six information items obtained in units of one accent phrase acquired in the steps S1–S3, and concerning the text "Since the name of the era was erroneously written 'Hyosei', it has been revised to a correct era 'Heisei'". At the step S1, the following processes are executed: "division of the text into accent phrases", "determination of the 'part of speech in an independent word section", "setting of a flag indicating 'Hyosei' that is not registered in the Japanese text analysis dictionary 14", "numbering for intra-text position", "determining of the frequency of the same noun in the text", and "numbering of the order of appearance of the same noun in the text". FIG. 4B also shows that there are emphasis in the words "Hyosei" and "Heisei", which is as a result of that the syntactic structure analysis section has estimated that the focus of meaning is the correcting "Hyosei" to "Heisei", in the semantic analysis at the step S3.

After that, in the similarly-pronounced-word detecting section 108, addition of information on noun included in a pronounced text to the pronounced-word list (not shown), detection of word having only one different consonant in each accent phrase, and setting of "flags" indicating the order of appearance and the existence of a noun having a similar pronunciation are performed. (step S4).

FIG. 4C shows examples of information items output from the similarly-pronounced-word detecting section 108 when the text analysis results shown in FIG. 4B have been supplied thereto. A flag "1" is set for the determination that there is an "emphasis", and for the determination that there is a "similar pronunciation".

After that, the pitch pattern generating section 202 executes setting and interpolation of point pitches for each accent phrase, and outputs a pitch pattern to the synthesizing filter section 208 (step S5).

The speech segment selecting section 204 calculates an evaluation value indicating the degree of intelligibility of synthesized speech in units of one accent phrase on the basis of the pronounciation of each accent phrase included in the information output from the similarly-pronounced-word detecting section 108, the part of speech of each independent word included in each accent phrase, unknown-word information, the position of each accent phrase in a text, the frequency of each noun included in each accent phrase and the order of appearance of each noun in the to-be-synthesized text, flags indicating the order of appearance and the existence of words having similar pronunciations in the text, and the determination as to whether or not each accent phrase is emphasized. Then, the section 204 determines and selects speech segments registered in a speech segment dictionary of a rank corresponding to the evaluation value (step S6).

Referring then to the flowchart of FIGS. 5 and 6, a description will be given of the calculation of the evaluation value of degree of intelligibility for each accent phrase and the determination of a speech segment dictionary based on the evaluation (step S6).

First, information concerning a target accent phrase (the first accent phrase at the beginning of processing) is extracted from information output from the similarly-pronounced-word detecting section 108 (step S601).

Subsequently, the part of speech in an independent word section included in the information (such as text analysis results) concerning an extracted accent phrase is checked, thereby determining a score from the type and imparting the score to the accent phrase (steps S602 and S603). A score of 1 is imparted to any accent phrase if the type of its independent word section is one of "noun", "adjective", "adjective verb", "adverb", "participial adjective" or "interjection", while a score of 0 is imparted to the other accent phrases.

After that, the unknown-word flag included in the information on the extracted accent phrase is checked, thereby determining the score on the basis of the on- or off-state (1/0) of the flag, and imparting it to the accent phrase (steps S604 and S605). In this case, the score of 1 is imparted to any accent phrase if it contains an unknown word, while the score of 0 is imparted to the other phrases.

Subsequently, information on the intra-text position included in information concerning the extracted accent phrase is checked, thereby determining the score on the basis of the intra-text position and imparting it to the phrase (steps S606 and S607). In this case, the score of 1 is imparted to any accent phrase if its intra-text position is the first one, while the score of 0 is imparted to the other accent phrases.

Then, information on the frequency of appearance contained in the information concerning the extracted accent phrase is checked, thereby determining the score on the basis of the frequency of each noun contained in the accent phrase (obtained from the Japanese text analysis dictionary 105) and imparting it to the phrase (steps S608 and S609). In this case, the score of 1 is imparted to any accent phrase if its noun frequency is less than a predetermined value, for example, if it is not more than 2 (this means that the noun(s) is unfamiliar), while the score of 0 is imparted to the other accent phrases.

Thereafter, information on the order of appearance included in the information concerning the extracted accent phrase is checked, thereby determining the score on the basis of the order of appearance of the same noun included in the accent phrase as appeared in the to-be-synthesized text, and imparting it to the accent phrase (steps S610 and S611). In this case, the score of −1 is imparted to any accent phrase if the order of appearance of a noun in the to-be-synthesized text is the second or more (in other words, the order of appearance of a noun included therein is the second or more), while the score of 0 is imparted to the other accent phrases.

After that, information indicating whether or not there is an emphasis, and included in the information concerning the extracted accent phrase is checked, thereby determining the score on the basis of the determination as to whether or not there is an emphasis, and imparting it to the accent phrase (steps S612 and S613). In this case, the score of 1 is imparted to any accent phrase if it is determined to contain an emphasis, while the score of 0 is imparted to the other accent phrases.

Then, information indicating whether or not there is a similarly pronounced word, and included in the information concerning the extracted accent phrase is checked, thereby determining the score on the basis of the determination as to whether or not there is a similarly pronounced word, and imparting it to the accent phrase (steps S612 and S613). In this case, the score of 1 is imparted to any accent phrase if it is determined to contain a similarly pronounced word, while the score of 0 is imparted to the other accent phrases.

Then, the total score obtained with respect to all items of the information on the extracted accent phrase is calculated (step S616). The calculated total score indicates the degree of intelligibility required for synthesized speech corresponding to each accent phrase. After the processing at the step 616, the degree of intelligibility evaluation processing for each accent phrase is finished.

After finishing the degree of intelligibility evaluation processing, the speech segment selecting section 204 checks the obtained degree of intelligibility (step S617), and determines on the basis of the obtained degree of intelligibility which one of the 0th-rank speech segment dictionary 22, the first-rank speech segment dictionary 24 and the second-rank speech segment dictionary 26 should be used.

Specifically, the speech segment selecting section 204 determines the use of the 0th-rank speech segment dictionary 22 for a accent phrase with a degree of intelligibility of 0, thereby selecting, from the 0th-rank speech segment dictionary 22, a speech segment string set in units of CV, corresponding to the accent phrase, and produced naturally (steps S618 and S619). Similarly, the speech segment selecting section 204 determines the use of the first-rank speech segment dictionary 24 for a accent phrase with a degree of intelligibility of 1, thereby selecting, from the first-rank speech segment dictionary 24, a speech segment string set in units of CV and corresponding to the accent phrase (steps S620 and S621). Further, the speech segment selecting section 204 determines the use of the second-rank speech segment dictionary 26 for a accent phrase with a degree of intelligibility of 2 or more, thereby selecting, from the second-rank speech segment dictionary 26, a speech segment string set in units of CV, corresponding to the accent phrase, and produced with a high intelligibility (steps S622 and S623). Then, the speech segment selecting section 204 supplies the selected speech segment string to the speech segment connecting section 20 (step S624).

Figure 5:
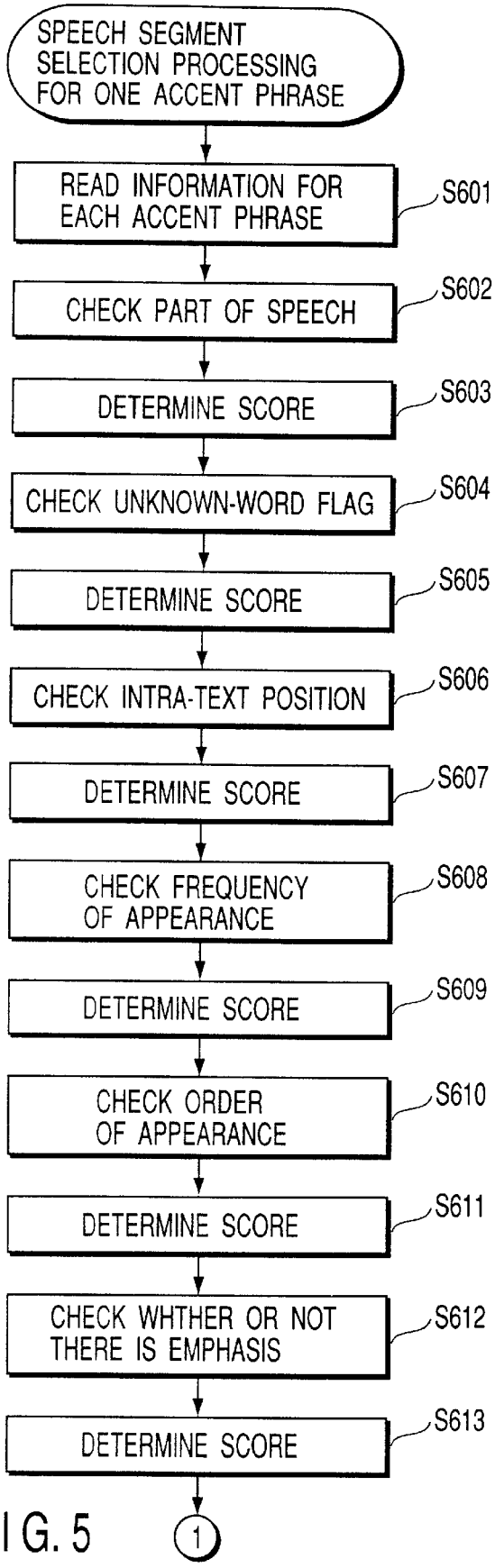
FIG. 5 is part of a flowchart useful in explaining score calculation for each accentual phrase and determination processing performed in a speech segment selecting section 204 by using a speech segment dictionary on the basis of the total value of score calculation results.
Figure 6:
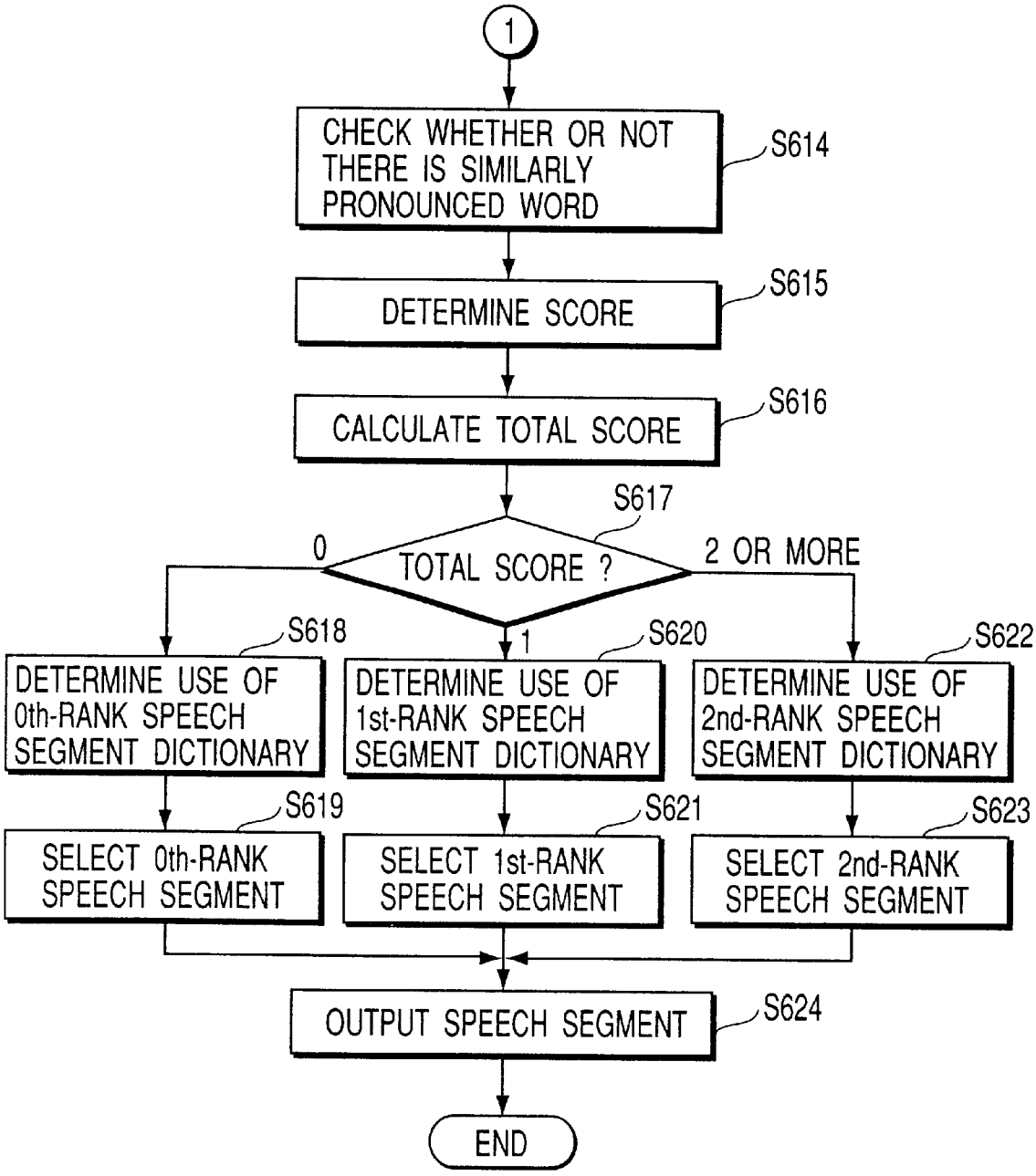
FIG. 6 is the remaining part of the flowchart useful in explaining the score calculation for each accent phrase and the determination processing performed in the speech segment selecting section 204 by using the speech segment dictionary on the basis of the total value (the degree of intelligibility) of the score calculation results.

The speech segment selecting section 204 repeats the above-described processing according to the flowchart of FIGS. 5 and 6, in units of one accent phrase for all accent phrases from the first accent phrase to the final accent phrase output from the similarly-pronounced-word detecting section 108.

FIG. 7 shows the scoring result of each accent phrase in the speech segment selecting section 204, which is obtained when the information output from the similarly-pronounced-word detecting section 108 is as shown in FIG. 4C. In this case, the speech segment (speech segment dictionary) selecting result of the speech segment selecting section 204 is as shown in FIGS. 8A and 8B.

As is shown in FIG. 8A, double underlines are attached to accent phrases which have the score of 2 or more in the input text "Since the name of the era was erroneously written 'Hyosei', it has been revised to correct era 'Heisei'". Concerning each of three accent phrases, "the name of era", "Hyosei" and "Heisei", a second-rank speech segment string registered in the second-rank speech segment dictionary 26 is selected. Similarly, concerning a accent phrase with the score of 1, i.e. each of two accent phrases, "a correct era" and "has been revised" to which one underline is attached in FIG. 8A, a corresponding first-rank speech segment string registered in the first-rank speech segment dictionary 24 is selected as shown in FIG. 8B. On the other hand, concerning a accent phrase with the score of 0, i.e. to which no underline is attached in FIG. 8A, a corresponding 0th-rank speech segment string registered in the 0th-rank speech segment dictionary 22 is selected as shown in FIG. 8B.

Thus, the speech segment selecting section 204 sequentially reads a speech segment string set in units of CV from one of the three speech segment dictionaries 22, 24 and 26 which contain speech segments with different degrees of intelligibility, while determining one speech segment dictionary for each accent phrase. After that the speech segment selecting section 204 supplies the string to the speech segment connecting section 206.

The speech segment connecting section 206 sequentially performs interpolation connection of speech segments selected by the above-described selecting processing, thereby generating a phonetic parameter for speech to be synthesized (step S7).

After each phonetic parameter is created as described above by the speech segment connecting section 206, and each pitch pattern is created as described above by the pitch pattern generating section 202, the synthesizing filter section 208 is activated. The synthesizing filter section 208 outputs speech through the LMA filter, using white noise in a voiceless zone and impulse in a voice zone as an excitation sound source (step S8).

The present invention is not limited to the above embodiment, but may be modified in, for example, the following manners (1)–(4) without departing from its scope:

(1) Although in the above embodiment, cepstrum is used as a feature parameter of speech, another parameter such as LPC, PARCOR, formant, etc. can be used in the present invention, and a similar advantage can be obtained therefrom. Further, although the embodiment employs an analysis/synthesis type system using a feature parameter, the present invention is also applicable to a waveform editing type, such as PSOLA (Pitch Synchronous OverLap-Add) type, or formant/synthesizing type system. Also in this case, a similar advantage can be obtained. Concerning pitch generation, the present invention is not limited to the point pitch method, but also applicable to, for example, the Fujisaki model.

(2) Although the embodiment uses three speech segment dictionaries, the number of speech segment dictionaries is not limited. Moreover, speech segments of three ranks are prepared for each type of synthesis unit in the embodiment. However only a single speech segment may be commonly used for some synthesis units, if intelligibility of the synthesis units does not greatly change between each type of synthesis unit and the intelligibility of the synthesis units don't have to be evaluated.

(3) The embodiment is directed to rule-based speech synthesis of a Japanese text in which Chinese characters and Japanese syllabaries are mixed. However, it is a matter of course that the essence of the present invention is not limited to Japanese. In other words, rule-based speech synthesis of any other language can be executed by adjusting, to the language, a text, a grammar for analysis, a dictionary used for analysis, each dictionary that stores speech segments, pitch generation in speech synthesis.

(4) In the embodiment, "degree of intelligibility" is defined on the basis of four standards such as grammar, meaning, familiarity, and pronunciation, and used as means for analyzing the intelligibility of a to-be-synthesized text, and text analysis and speech segment selection is performed on the basis of the degree of intelligibility. However, it is a matter of course that the "degree of intelligibility" is just one means. The standard that can be used to analyze and determine the intelligibility of a to-be-synthesized text is not limited to the aforementioned degree of intelligibility, which is determined from grammar, meaning, familiarity, and pronunciation, but anything that will influence the intelligibility can be used as a standard.

As described in detail, in the present invention, a plurality of speech segments of different degrees of intelligibility are prepared for one type of synthesis unit, and, in the TTS, speech segments of different degrees of intelligibility are properly used in accordance with the state of appearing words. As a result, natural speech can be synthesized which can be easily heard and can keep the listener comfortable even after they heard it for a long time. This feature will be more conspicuous if speech segments of different degrees of intelligibility are changed from one to another, when a word that has an important role for constituting a meaning is found in a text, when a word has appeared for the first time in the text, when a word unfamiliar to the listener has appeared, or when a word which has a similar pronunciation to that of a word having already appeared has appeared, and the listener may mistake the meaning of the word.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A speech synthesizing apparatus comprising:

means for dissecting text data, subjected to speech synthesis, into an accent phrase unit and analyzing the accent phrase unit, thereby obtaining a text analysis result;

a speech segment dictionary that stores a plurality of speech segments and a plurality of speech parameters that correspond to each speech segment, the speech parameters being prepared for a plurality of degrees of intelligibility;

means for determining a degree of intelligibility of the accent phrase unit, on the basis of the text analysis result; and means for selecting speech parameters stored in the speech segment dictionary corresponding to the determined degree of intelligibility of the accent phrase unit, and then connecting the speech parameters to generate synthetic speech.

2. A speech synthesizing apparatus according to claim 1, wherein the text analysis result includes at least one information item concerning grammar, meaning, familiarity and pronunciation; and said means for determining a degree of intelligibility determines the degree of intelligibility on the basis of at least one of the information items concerning the grammar, meaning, familiarity and pronunciation.

3. A speech synthesizing apparatus according to claim 2, wherein, the information item concerning the grammar includes at least one of a first information item indicating a part of speech included in the accent phrase unit, and a second information item indicating whether the accent phrase unit is an independent word or a dependent word, the information item concerning the meaning includes at least one of a third information item indicating the position of the accent phrase unit in a text, and a fourth information item indicating whether or not there is an emphasis, the information item concerning the familiarity includes at least one of a fifth information item indicating whether or not the accent phrase unit includes an unknown word, a sixth information item indicating a degree of familiarity of the accent phrase unit, and a seventh information item for determining whether or not the accent phrase unit is at least a first one of the same words in the text, the information item concerning the pronunciation includes an eighth information item concerning phoneme information of the accent phrase unit, and a ninth information item indicating whether or not the accent phrase unit includes a word having a similar pronunciation to a word included in another accent phrase unit, and the means for determining a degree of intelligibility of the accent phrase unit determines the degree of intelligibility on the basis of at least one of the first to ninth information items included in the text analysis result.

4. A speech synthesizing apparatus according to claim 3, wherein said means for dissecting data obtains, as the seventh information item, appearance order information indicating an order of appearance among same words in the text, and said means for determining a degree of intelligibility of the accent phrase unit determines the degree of intelligibility of the text data on the basis of the appearance order information.

5. A mechanically readable recording medium storing a text-to-speech conversion program for causing a computer to execute the steps of:

dissecting text data, to be subjected to speech synthesis, into an accent phrase unit, and analyzing the accent phrase unit to obtain a text analysis result;

determining, on the basis of the text analysis result, a degree of intelligibility of the accent phrase unit; and selecting speech parameters corresponding to the determined degree of intelligibility of the accent phrase unit from a speech segment dictionary, in which a plurality of speech segments and a plurality of speech parameters that correspond to each speech segment are stored, on the basis of the plurality of degree of intelligibility and connecting the speech parameters to obtain synthetic speech.

6. A mechanically readable recording medium according to claim 5, wherein the text analysis result includes at least one information item concerning grammar, meaning, familiarity and pronunciation; and at the step of determining a degree of intelligibility of the accent phrase unit, the degree of intelligibility on the basis of at least one of the information items concerning grammar, meaning, familiarity and pronunciation is determined.

7. A mechanically readable recording medium according to claim 6 wherein, the information item concerning the grammar includes at least one of a first information item indicating a part of speech included in the accent phrase unit, and a second information item indicating whether the accent phrase unit is an independent word or a dependent word, the information item concerning the meaning includes at least one of a third information item indicating the position of the accent phrase unit in a text, and a fourth information item indicating whether or not there is an emphasis, the information item concerning the familiarity includes at least one of a fifth information item indicating whether or not the accent phrase unit includes an unknown word, a sixth information item indicating a degree of familiarity of the accent phrase unit, and a seventh information item for determining whether or not the accent phrase unit is at least a first one of the same words in the text, the information item concerning the pronunciation includes an eighth information item concerning phoneme information of the accent phrase unit, and a ninth information item indicating whether or not the accent phrase unit includes a word having a similar pronunciation to a word included in another accent phrase unit in the text, and at the step of determining a degree of intelligibility of the accent phrase unit, the degree of intelligibility on the basis of at least one of the first to ninth information items included in the text analysis result is determined.

8. A mechanically readable recording medium according to claim 7, wherein at the step of dissecting the text data, as the seventh information item, appearance order information indicating an order of appearance among same words in the text is obtained, and at the step of determining a degree of intelligibility, the degree of intelligibility of the text data on the basis of the appearance order information is determined.

9. A mechanically readable recording medium storing a text-to-speech conversion program for causing a computer to execute the steps of:

dissecting text data, to be subjected to speech synthesis, into an accent phrase unit to obtain a text analysis result for the accent phrase unit, the text analysis result including at least one information item concerning grammar, meaning, familiarity and pronunciation;

determining a degree of intelligibility of the accent phrase unit, on the basis of the at least one of the information items concerning the grammar, meaning, familiarity and pronunciation;

selecting speech parameters corresponding to the determined degree of intelligibility of the accent phrase unit from a speech segment dictionary, in which a plurality of speech segments and a plurality of speech parameters that correspond to each speech segment are stored, on the basis of the plurality of degree of intelligibility and connecting the speech parameters to obtain synthetic speech;

wherein the information item concerning the grammar includes at least one of a first information item indicating a part of speech included in the accent phrase unit, and a second information item indicating whether the accent phrase unit is an independent word or a dependent word;

the information item concerning the meaning includes at least one of a third information item indicating the position of the accent phrase unit in a text, and a fourth information item indicating whether or not there is an emphasis;

the information item concerning the familiarity includes at least one of a fifth information item indicating whether or not the accent phrase unit includes an unknown word, a sixth information item indicating a degree of familiarity of the accent phrase unit, and a seventh information item for determining whether or not the accent phrase unit is at least a first one of the same words in the text; and the information item concerning the pronunciation includes an eighth information item concerning phoneme information of the accent phrase unit, and a ninth information item indicating whether or not the accent phrase unit includes a word having a similar pronunciation to a word included in another accent phrase unit in the text;

and in determining the degree of intelligibility of the accent phrase unit, the determination is executed on the basis of at least one of the first to ninth information items included in the text analysis result.

* * * * *